United States Patent [19]

Kondo et al.

[11] 4,225,758

[45] Sep. 30, 1980

[54] SWITCH OPERATED AXIALLY OR ROTATABLY

[75] Inventors: Shiro Kondo; Yoshinori Watanabe, both of Furukawa, Japan

[73] Assignee: Alps Electric Co., Ltd., Tokyo, Japan

[21] Appl. No.: 921,469

[22] Filed: Jul. 3, 1978

[30] Foreign Application Priority Data

Jul. 6, 1977 [JP] Japan ..... 52-89333[U]

[51] Int. Cl.[2] ..... H01H 21/68

[52] U.S. Cl. ..... 200/4; 200/16 B; 200/11 G; 200/153 K; 200/159 A

[58] Field of Search ..... 200/4, 7, 11 G, 16 B, 200/16 E, 61.54, 62 R, 63 R, 67 C, 153 K, 159 A, 11 K

[56] References Cited

U.S. PATENT DOCUMENTS

| | | | |
|---|---|---|---|
| 3,013,129 | 12/1961 | Root | 200/44 |
| 3,431,371 | 3/1969 | Stoi et al. | 200/159 A X |
| 3,499,125 | 3/1970 | Stoi | 200/4 |
| 3,511,943 | 5/1970 | Kibler | 200/4 |
| 3,696,222 | 10/1972 | Langan et al. | 200/16 B |

*Primary Examiner*—James R. Scott

*Attorney, Agent, or Firm*—Guy W. Shoup; Gerard F. Dunne

[57] ABSTRACT

A switch suitable for use in digital clocks for automobiles comprises a case and a plurality of fixed terminals secured within the case. A contact member movable axially or rotatably by a shaft has a plurality of contact elements. A first spring member operates to return the contact member to its initial position after it has been rotated to effect a switching function and a second spring returns the contact to its initial axial position after the contact member has been moved axially to effect a switching function. The switch can thus provide any of these switching functions by being operated by rotating the shaft in either of two directions, or by axially moving the shaft.

11 Claims, 19 Drawing Figures

SWITCH OPERATED AXIALLY OR ROTATABLY

BACKGROUND OF THE INVENTION

The present invention relates to a switch which allows different fixed terminals therein to be connected when an operation shaft is moved in the axial direction or turned to right or left, and which is automatically returned to its initial state when the force exerted on the operation shaft is released. More particularly, the present invention is concerned with a multioperational switch which is suitable for use as a switch for digital clocks.

An object of the present invention is to provide a multioperational switch which is particularly suitable as a switch for digital clocks.

To this end, according to the present invention, there is provided a multi-operational switch comprising a case and a plurality of fixed terminals secured to the case. The terminals include a first fixed terminal member and at least one second fixed terminal. A movable contact member having a plurality of contact elements is movable axially or rotatably within the case by means of an operation shaft. A first spring member operates to return the contact member to its initial rotational position; and a second spring urges the contact member into the initial axial position. Different fixed terminal are connected alternatively by the movable contact elements when the operation shaft is rotated either clockwise or counter-clockwise, and the first fixed terminal and at least one of the second fixed terminal are connected by the movable contact elements when the operation shaft is moved in the axial direction.

The above and other objects as well as advantageous features of the invention will become apparent from the following description of the preferred embodiments taken in conjunction with the accompanying drawings.

DESCRIPTION OF THE PREFERRED EMBODIMENTS

An embodiment of the present invention will be described with reference to FIGS. 1–8.

Figure 3:
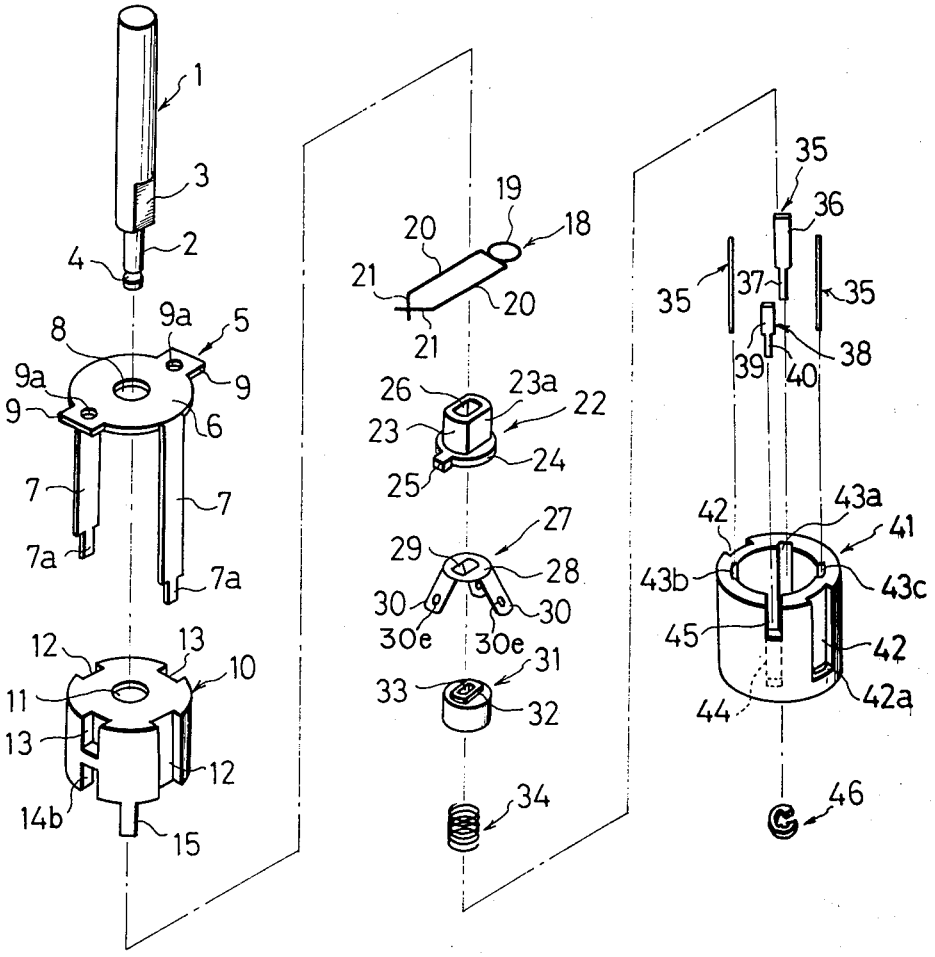
FIG. 3 is an exploded view of the embodiment as shown in FIG. 1.

Referring to the drawings, an operation shaft 1 made of a synthetic resin or like material has an end portion formed with a smaller diameter so as to provide a shaft portion 2, as can be seen clearly in FIG. 3. The larger diameter portion of the operation shaft 1 is provided near its junction with the shaft portion 2 with flat surfaces 3 facing oppositely from the shaft 1. The flat surfaces are parallel to the axis of the shaft 1 and serve as mounts for fitting to the shaft 1 a rotor 22 and a spring receiver 31 which will be described later. The shaft portion 2 is provided at the end portion thereof with an annular recess 4 for fitting an E ring 46 therein.

Reference numeral 5 denotes a strap member made of metal or the like for securing a cover member 10 to the switch case 41, as will be described later. The strap member has a circular base portion 6 and two leg portions 7 each extending perpendicularly from opposite portions of the periphery of base portion 6. The base portion 6 is also provided with a hole 8 through which the operation shaft 1 is inserted, as well as two ear portions 9 extending from opposite peripheral portions thereof. The ear portions 9 extend horizontally from the peripheral portions of the base portion at locations spaced 90° from the leg portions 7 and are used as tabs when the strap member 5 is removed. Reference numerals *7a* denote bendable fastener portions on the ends of the leg portions, and *9a* denotes positioning projections extending downwardly from the ear portions 9.

Figure 1:
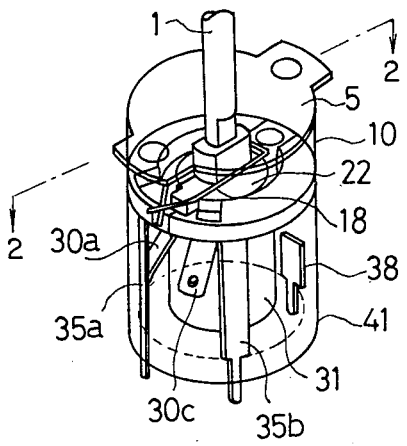
FIG. 1 is a perspective view, partially broken away of an embodiment of the multi-operational switch according to the present invention.
Figure 2:
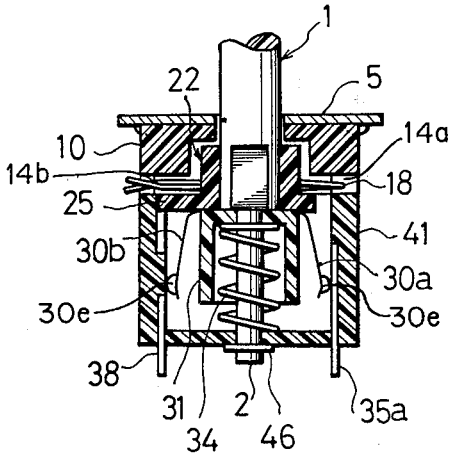
FIG. 2 is a cross-sectional view taken along the line 2—2 in FIG. 1.
Figure 4:
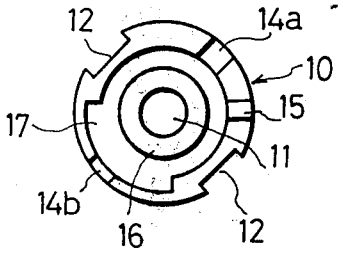
FIG. 4 is a bottom view of the cover member of the embodiment of FIG. 1.

Reference numeral 10 denotes a generally cylindrical cover member made of a synthetic resin or like material, which is provided, as shown in FIGS. 3 and 4, with a cylindrical passage 11 in the upper central portion thereof through which the operation shaft 1 is inserted. The cover member 10 is also provided with shallow recesses 12 extending axially in opposite portions on the outer circumferential surface thereof and in which the leg portions 7 of the strap member 5 are fitted. Further, two upper recesses 13, and lower recesses *14a* and *14b* are provided in the outer circumferential surface of the cover member 10 at locations spaced 90° from the recesses 12. In each upper recess 13 a respective projection *9a* of the strap member 5 is fitted and, a spring member 18 is engaged with the recesses *14a* and *14b*, as will be described later. At the peripheral portion of the lower end of the cover member 10, a positioning guide projection 15 is provided which is engaged in a recess 45 provided in the switch case 41. The bottom surface of the cover member 10 is also provided, as shown in FIG. 4, with an annular recess 16 concentric with the passage 11, and a mount portion of the rotor 22 can be fitted in the annular recess 16. The bottom surface of the cover member 10 is further provided with a fan-shaped recess 17 formed by reducing the thickness of a part of the side wall of the bottom portion thereof, and this recess 17 allows a projection 25 of the rotor 22 to be loosely fitted therein so as to restrict the rotary movement of the rotor.

Reference numeral 18 denotes a spring member for returning the rotor 22 to its initial position after it has been rotated. The spring member 18 is made from a resilient metal wire and consists of a circular portion 19, two linear portions 20 extending generally parallel and each connected at its end to the circular portion 19, and two angled portions 21 which are formed by bending inwardly each of the free end portions of the linear portions 20 in a like manner. The distance between the linear portions 20 is substantially equal to that between the two parallel surfaces 23*a* of the rotor 22, which will be described later.

Reference numeral 22 is a rotor made from a synthetic resin or like material and includes a cylindrical mounting portion 23 having parallel outer surfaces 23*a* and a disc-type flange portion 24 having a projection 25 at the peripheral portion thereof, which projection 25 serves as a stopper. The rotor 22 is provided with a substantially elliptical passage 26 in the central portion thereof, through which the mounts 3 of the operation shaft 1 are inserted. The bottom surface of the flange portion 24 is provided with a substantially elliptical recess (not shown) in which an upstanding projection 32 of the spring receiver 31 is fitted, as will be described below.

Reference numeral 27 denotes a sliding member made of a sheet of metal having a good resiliency and conductivity, for example, phosphor bronze, which has a circular base portion 28 having a substantially elliptical opening 29 into which the upstanding projection 32 of the spring receiver 31 is fitted, and four spring legs 30 having equal lengths and being divergently extended from the periphery of the base portion 28. Each of the spring legs has a contact element 30e on the free end portion thereof. Assuming that the four spring legs are represented by numerals 30*a*, 30*b*, 30*c* and 30*d*, respectively, the angular positions thereof with respect to the center (which coincides with the axis of the operation shaft 1) of the opening 29 will be set forth. Two of the spring legs i.e. 30*a* and 30*b*, are positioned at 180° from one another around the periphery of the base portion 28 (i.e. in the opposite positions with respect to the center of the opening 29), and two of the spring legs, i.e. 30*c* and 30*d*, are spaced 45° in respective directions around the base portion 28 from the spring leg 30*a*. This arrangement is illustrated clearly in FIG. 5A.

Reference numeral 31 denotes a generally cylindrical and hollow cap type spring receiver made of a synthetic resin or like material and having a substantially elliptical upstanding projection 32 on the upper circular surface thereof. The projection 32 has an opening 33 in which the mounts 3 of the operation shaft 1 are fitted. Into the inside of the hollow portion of the spring receiver 31, the upper end portion of a coil spring 34, for returning the operation shaft 1, is inserted to be held therein.

Reference numeral 35 denotes three fixed terminals each of which includes a fixed contact portion 36 and a terminal portion 37. Reference numeral 38 denotes a short fixed terminal which consists of a fixed contact portion 39 and a terminal portion 40. The fixed contact portion 39 is shorter than the fixed contact portions 36 of the fixed terminals 35.

Reference numeral 41 denotes a bottomed cylindrical switch case made of a synthetic resin or like material and having at opposite portions of the outer circumferential surface thereof, two axial and shallow recesses 42, which each engage with respective leg portions 7 of the strap member 5. At the lower end portions 42*a* of each recesses 42, a passage (not shown) opens at the bottom surface of the switch case 41 for receiving the fastener portions 7*a* of the leg portions 7 of the strap member. The switch case 41 is provided in the inner surface thereof with recesses 43*a*, 43*b*, 43*c* and 44 in which the three fixed terminals 35 and the short fixed terminal 38 are respectively fitted. The recesses 43*a*, 43*b*, 43*c* and 44 are spaced 90° from one another around the inner surface of the switch case, with the recess 43*a* being disposed across from the recess 44 and the recess 43*b* disposed across from the recess 43*c*. At the lower end portions of the recesses 43*a*, 43*b*, 43*c* and 44, passages (not shown) are provided for receiving the respective terminal portions 37 or 40 of the fixed terminals 35 or 38, such that the lower ends thereof are projected from the bottom surface of the switch case 41.

The upper portion of the recess 44 is formed as a slot 45 to engage with the guide projection 15 of the cover 10. When the guide projection 15 is engaged with the slot 45, the recesses 42 in the switch case 41 are aligned with the recesses 12 in the cover 10. At the central portion of the bottom surface of the switch case 41, an opening (now shown) is provided so that the shaft portion 2 of the operation shaft 1 is supported therein.

Reference numeral 46 denotes an E-ring which is engaged with the annular recess 4 provided in the shaft portion 2 of the operation shaft 1 and which serves to prevent the operation shaft 1 from coming out from the switch case 41.

Now the assembling of the switch of the above embodiment which includes of the above-mentioned parts will be described.

Figure 8A:
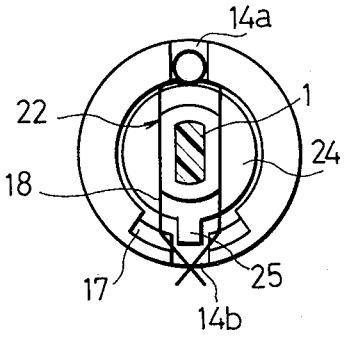
FIGS. 8A–8C show the movements of the rotor and spring of the embodiment of FIG. 1 when the operation shaft is rotated counter-clockwise and clockwise, respectively.
Figure 8B:
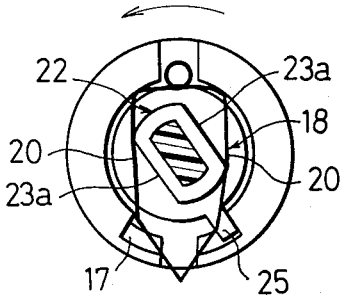

The rotor 22 and the spring receiver on which the sliding member 27 is mounted are fitted in order on the mounts 3 of the operation shaft by passing the operation slot 3 through the passages 26, 33 respectively, so that the coil spring 34 is mounted on the shaft portion 2. The operation shaft 1 is then inserted in the switch case 41 in which the fixed terminals 35 and short fixed terminal 38 have been fitted, with the upper end portion of the coil spring 34 inserted in the coil receiver 31. The shaft portion 2 is then inserted in the opening in the bottom wall of the switch case 41 against the resilient force of the coil spring 34, and the E-ring 46 is fitted into the annular recess 4 in the shaft portion 2 which is projected beyond the bottom surface of the switch case 41, so as to prevent the operation shaft 1 from coming out from the switch case 41. Then, the circular portion 19 and angled portions 21 of the spring member 18 are fitted in the recesses 14*a* and 14*b* in the cover member 10. The operation shaft 1 is then inserted in the cylindrical passage 11 in the cover member 10 on which the spring member 18 is mounted, and the guide projection 15 is engaged with the slot 45 in the switch case 41 to fit the cover member 10 therewith. At this time, the projection 25 of the rotor 22 and the angled portions 21 of the spring member 18 are positioned within the fan-shaped recess 17 in the switch cover member 10 and the parallel flat surfaces 23*a* lie along the linear portions 20 of the spring member 18 as shown in FIG. 8A. At this same time, the sliding member 27 is so mounted between the spring receiver 31 and the rotor 22 that the spring leg 30*b* lies adjacent the short fixed terminal 38.

The operation shaft 1 is therafter inserted through the hole 8 in the strap member 5, and the leg portions 7 thereof are fitted in the recesses 12 and 42 in the cover member 10 and case 41, respectively. The fastener portions 7*a* of the leg portions 7 are passed through the passage provided at the lower ends of the recesses 42, and the lower end portions of the fastener portions 7*a* that are projected beyond the bottom surface of the switch case are bent so as to fix the cover member 10 in the case 41. Thus, the assembling of the switch is completed.

The operation of the switch of the above embodiment will be described with reference to FIGS. 5–8.

Figure 5A:
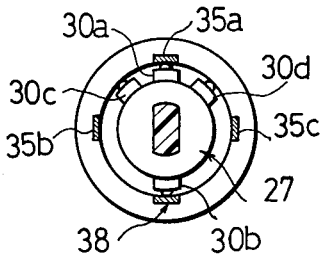
FIGS. 5A–5C show the axial movements of the operation shaft of the embodiment of FIG. 1.
Figure 5B:
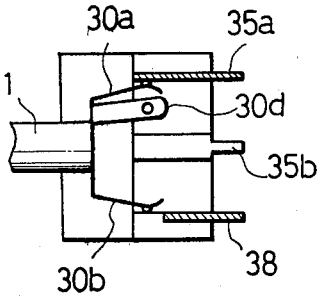

When the switch is not actuated, the spring receiver 31 is urged upwardly by the resilient force of the coil spring 34 so that the rotor 22 is stopped as the upper end surface thereof is in contact with the inner surface of the upper wall of the cover member 10. At this time, as shown in FIGS. 5A, 5B, and 8A, the spring leg 30*a* of the sliding member 27 is in contact with the fixed terminal 35*a*, and the spring leg 30*b* is displaced axially away from the short fixed terminal 38 with the spring legs 30*c* and 30*d* also away from the fixed terminals 35*a* and 35*c*, respectively. Namely, these fixed terminals 35*a*, 35*b*, 35*c* and 38 are not electrically interconnected. While the switch is not actuated, the projection 25 of the rotor 22 is held in the central angular position in the fan-shaped recess 17 in the cover member 10 by the resilient force of the spring member 18.

Figure 5C:
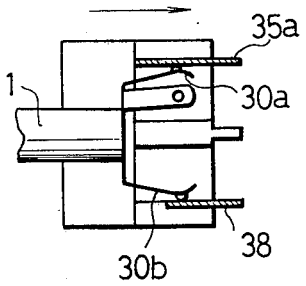

When the operation shaft 1 in the above-mentioned state is depressed in the axial direction against the resilient force of the coil spring 34, the operation shaft 1 is moved axially and the rotor 22 and sliding member 27 are thereby also moved (at this time, the spring member 18 is moved relative to the rotor 22). At this time, the spring legs 30*a* and 30*b* contact the fixed terminal 35*a* and short fixed terminal 38, respectively, as shown in FIG. 5C, and these fixed terminals 35*a* and 38 are electrically interconnected. The depressing of the operation shaft 1 is then discontinued, and the operation shaft 1 returns to its initial position by the resilient force of the coil spring 34.

Figure 6A:
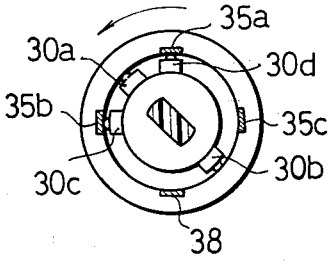
FIGS. 6A and 6B show the operation shaft of the embodiment of FIG. 1 rotated counter-clockwise.
Figure 6B:
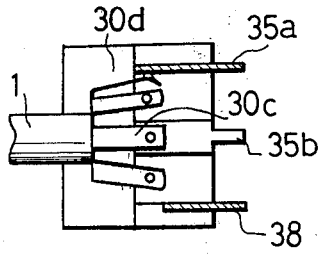

When the operation shaft 1 of the switch in a nonoperated state is turned counter-clockwise as shown in FIGS. 6A and 6B, the rotor 22 is rotated together with the sliding member 27, and the spring legs 30*c* and 30*d* contact the fixed terminals 35*b* and 35*a*, respectively, so that these fixed terminals 35*b* and 35*a* are electrically interconnected. At this time, the projection 25 of the rotor 22 contacts one end of the fan-shaped recess 17 to stop the rotation thereof. Also, the linear portions 20 of the spring member 18 are deflected by the edge portions of the parallel surfaces 23*a* and the former are pushed outwardly by the latter. Consequently, a force couple is exerted by the resilient force of the spring member 18 on the rotor 22 in a direction opposite to the one in which the rotary force is exerted thereon. When the rotary force exerted on the operation shaft 1 is then released, the rotor 22 is rotated clockwise by the above-mentioned couple and returned to its initial state.

Figure 7A:
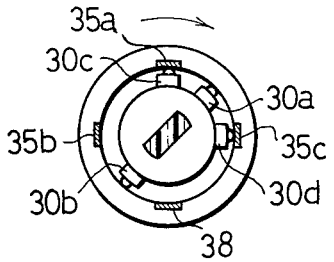
FIGS. 7A and 7B show the operation shaft of the embodiment of FIG. 1 rotated clockwise.
Figure 7B:
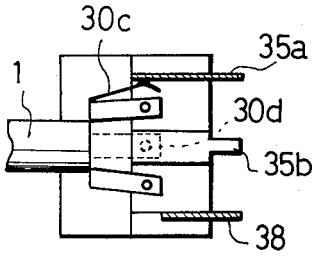
Figure 8C:
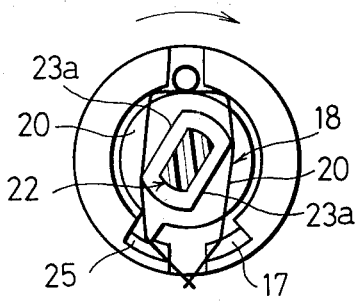

When the operation shaft 1 is turned clockwise as shown in FIGS. 7A and 7B, the spring legs 30*c* and 30*d* contact the fixed terminals 35*a* and 35*c*, respectively, in the same manner as mentioned above so that these fixed terminals 35*a* and 35*c* are electrically interconnected. At this time, the projection 25 of the rotor 22 contacts the other end of the fan-shaped recess 17 as shown in FIG. 8C to stop the rotation thereof, and the linear portions 20 of the spring member 18 are outwardly deflected. When the rotary force exerted on the operation shaft 1 is released, it is returned to its initial state in the same manner as mentioned above. As can thus be appreciated by those in the art, fixed terminal 35*a* is a common terminal for operation of the switch.

When the operation shaft 1 in a non-operation state is turned to right or left, the spring leg 30*b* is away from the short fixed terminal 38 so they do not contact one another.

In the switch of the above-described embodiment of the present invention, different fixed terminals are electrically connected to the common fixed terminal 35*a* when the operation shaft is axially depressed, or when the operation shaft 1 is turned either to the left or to the right.

Figure 9:
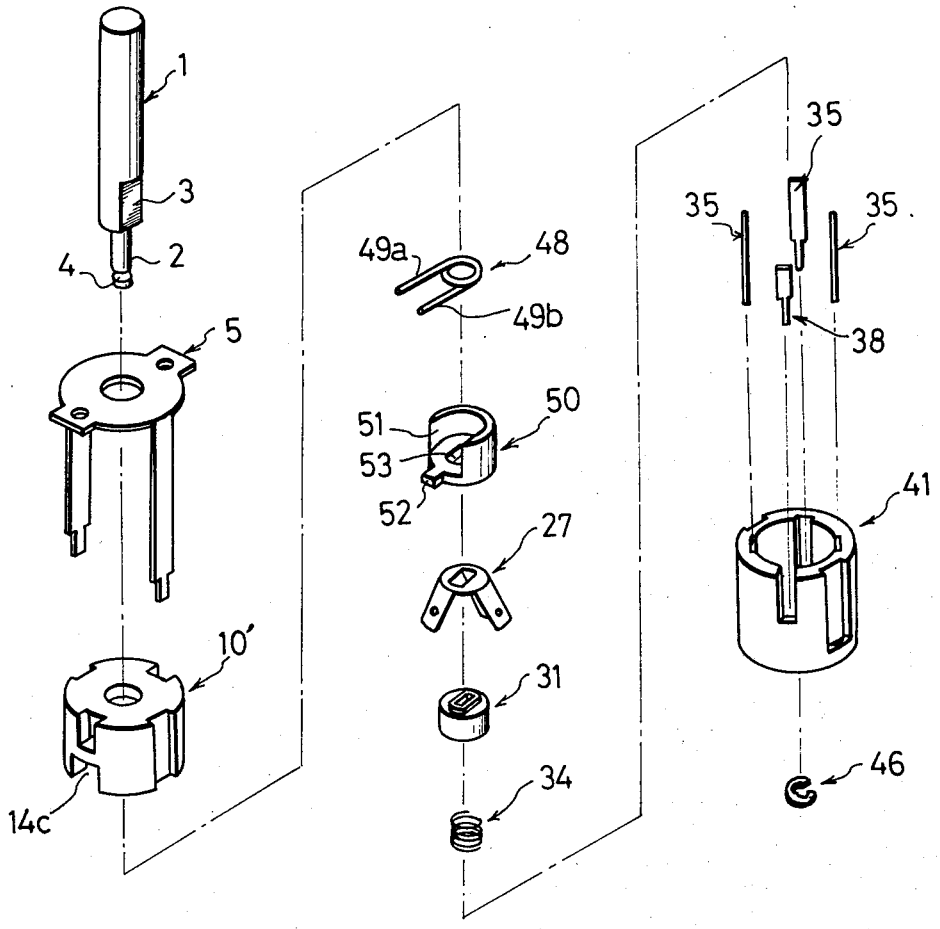
FIG. 9 is an exploded view of another embodiment of the switch according to the present invention.
Figure 10A:
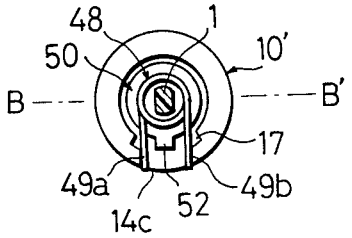
FIGS. 10A–10C show the movements of the rotor and spring of the embodiment of FIG. 9.
Figure 10B:
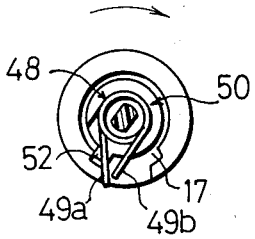
Figure 10C:
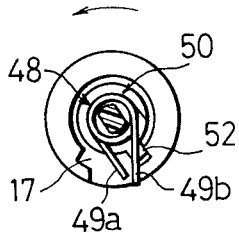
Figure 11:
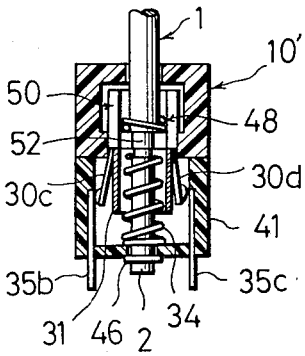
FIG. 11 is a cross-sectional view taken along the line B—B′ in FIG. 10.

FIGS. 9–11 show another embodiment of the switch of the present invention. The parts of this embodiment which are similar to parts of the embodiment of FIG. 3 have similar reference numerals.

Reference numerals 10' denotes a cover member provided with a recess 14*c* the width of which is greater than that of the recess 14*b* in the cover member 10 of the first embodiment. Reference numeral 48 denotes a spring member for returning a rotor 50 to its original position, and the spring member 48 has a coil portion at the ends thereof respective linearly extended parallel portions serving as fixing portions 49*a* and 49*b*. Through the coil portion of the spring member 48, the operation shaft 1 can be inserted. Reference numeral 50 denotes a bottomed cylindrical rotor having a cutout 51 in the cylindrical wall thereof as well as a projection 52 serving as a stopper in such a peripheral portion of the bottom wall that corresponds to the cutout 51. In the inner surface of the bottom wall of the rotor 50, a substantially elliptical opening 53 is provided for inserting therethrough the mounts 3 of the operation shaft 1. In the outer surface of the bottom wall of the rotor 50, a recess (not shown) is provided for fitting therein the projection 32 of the spring receiver 31.

The rotor 50, sliding member 27, spring receiver 31, coil spring 34 and E-ring 46 are mounted on the operation shaft 1 and the resulting shaft 1 is fitted in the case 41 in the same manner as in the first embodiment. The spring member 48 is then mounted on the operation shaft 1 and inserted in the rotor 50, and the fixing portions 49*a* and 49*b* are brought into contact with the side edges of the cutout 51 so that the fixing portions 49*a* and 49*b* are positioned within the recess 14*c* in the cover member 10'.

The operation of the switch of this embodiment will be described with reference to FIGS. 10A, 10B and 10C.

When the switch is not in operation, the fixing portions 49*a* and 49*b* of the spring member 48 contact the side edges of the recess 14*c* in the cover 10' as shown in FIG. 10A, and the projection 52 of the rotor 50 is positioned in the central portion of the fan-shaped recess 17. When the operation shaft 1 is turned clockwise, the fixing portion 49*b* of the spring member 48 is pushed by a side edge of the cutout 51 in the rotor 50 as shown in FIG. 10B while the fixing portion 49*a* is held by its engagement against the side wall of the recess 14*c*, and the fixing portion 49*b* is bent as it were wound around the spring member 48. At this time, a force for rotating the rotor 50 counterclockwise is exerted thereon due to the resilient force of the fixing portion 49*b*. When the rotory force exerted on the operation shaft 1 is released, the shaft will return to a non-operation state as shown in FIG. 10A.

When the operation shaft 1 in a non-operation state is then turned counter-clockwise, the fixing portion 49*a* of the spring member 48 is pushed by the other edge of the cutout 51 and bent inwardly as shown in FIG. 10C, and the projection 52 contacts the other edge of the fan-shaped recess 17 to stop the rotation of the rotor 50. When the rotary force exerted on the operation shaft 1 is then released, the operation shaft 1 will be returned to its original state as shown in FIG. 10A. When the operation shaft 1 in a non-operation state is depressed in the axial direction or when the operation shaft 1 is turned to right or left to shift the electrical connection, the same procedure as in the first embodiment is taken.

In the above embodiments, the angular positions of the spring legs 30*c* and 30*d* with respect to the spring leg 30*a* opposed to the common fixed terminal 35*a* are 45°, respectively, and the angular positions of the fixed terminals 35*b* and 35*c* with respect to the common fixed terminal 35*a* are 90°, respectively. Namely, the latter angular positions are one half of the former ones. It is not strictly necessary that the short fixed terminal 38 be disposed opposite to the common fixed terminal 35*a* with respect to the axis of the switch but, taking the design of the switch into consideration, it is convenient to dispose the spring legs and fixed terminals in the above-mentioned manner. This may of course be provided in different arrangements.

When the operation shaft of the multi-operation switch as described above according to the present invention is moved in the axial direction, or when it is turned clockwise or counter-clockwise, the common fixed terminal is connected to different fixed terminals in each case. When the force exerted on the operation shaft is released, the operation shaft is automatically returned to a non-operation state. Thus, the switch of the present invention is accurately operated and suitable for digital clocks, especially, digital clocks in automobiles. In fact, the switch of the present invention can be manufactured to comparatively small sizes and at a low cost. Moreover, it can be smoothly operated and produces good practical and manufacturing effects.

What is claimed is:

1. A switch operable to interconnect electrically selected various fixed terminals to a common terminal, comprising:

a case having a plurality of fixed terminals and a common terminal secured therewithin;

a sliding contact member movable axially and rotationally within said case and including a plurality of contact elements extending outwardly therefrom;

means including an operation shaft for moving said sliding member axially or rotationally for bringing selected ones of said contact elements into engagement with said common terminal and at least one selected fixed terminal;

a spring member operatively associated with said moving means for returning said sliding member to its initial rotational position after rotary movement thereof; and a second spring operatively associated with said moving means for returning said sliding member to its initial axial position after axial movement thereof;

whereby at least one fixed terminal will be electrically interconnected with said common terminal upon rotation of said shaft in a first direction and at least one of the other fixed terminals will be electrically interconnected with said common terminal upon rotation of said shaft in a second direction, and further at least one of the remaining fixed terminals will be electrically interconnected with said common terminal upon axial movement of said shaft.

2. A switch according to claim 1, said moving means including a rotor fixed to said shaft for rotation therewith, said rotor including a generally cylindrical mounting portion for receiving said shaft, said mounting portion having generally parallel outer flat surfaces; and said spring member includes two generally parallel linear portions resiliently interconnect at first end portions thereof, said linear portions lying adjacent respective ones of said flat surfaces for providing a return force to said rotor.

3. A switch according to claim 2, further including a cover member fitting over said rotor and including two lower recesses spaced oppositely in the side wall thereof, said linear portions being resiliently interconnected by a circular portion of said spring member integral with said first ends, and the second ends of said linear portions having angled portions integrally formed from respective second ends to extend towards one another, said circular portion and said angled portions fitting in respective ones of said lower recesses; whereby as said rotor rotates, said linear portions will deflect outwardly and said circular portion and said angled portions pressing against the walls of its respective lower recess will urge said rotor back to its initial position.

4. A switch according to claim 1, said moving means including a generally cylindrical rotor fixed to said shaft for rotation therewith, said rotor including a bottom wall for receiving said shaft and a side wall having a cutout portion, said spring member having a coil portion disposed on the inner surface of the bottom wall of said rotor and two fixing portions extending generally parallel from said coil portion to respective free end portions; said switch further including a cover member fitting over said rotor and including a recess in the side wall thereof aligned with said cutout portion with said free end portions lying adjacent a respective wall portion of said recess; whereby as said rotor rotates, one of said fixing portions will be deflected towards the other against the resilience force of said coil portion so as to urge said rotor back to its coil portion.

5. A switch according to claim 1, 2 or 4, said case being generally cylindrical and having said at least one fixed terminal and said at least one other fixed terminal circumferentially spaced about the inner wall thereof, and said at least one remaining fixed terminals being spaced on said inner wall at a location spaced axially and circumferentially from said common terminal.

6. A switch according to claim 1, 2 or 4, said sliding member having a generally circular base portion and four spring legs diverging outwardly from said base portion, each said spring leg carrying a respective contact element, a first and second of said spring legs being spaced approximately 180° from one another around the periphery of said base portion and a third and fourth of said spring legs being spaced approximately 45° in respective directions around said base portion from said first spring leg; said at least one fixed terminal being a single terminal and said at least one other fixed terminal being a single terminal, said single terminals each being spaced approximately 90° in respective directions around the inner wall of said case from said common terminal, said at least one remaining terminal being a single terminal spaced below said common terminal but offset approximately 180° around said inner wall from said common terminal.

7. A switch according to claim 1, 2 or 4, said sliding member having a generally circular base portion and including a plurality of spring legs diverging outwardly from said base portion, each said spring leg carrying a respective contact element; and a hollow spring receiver having a top wall underlying said base portion, said top wall of said spring receiver having an upstanding projection fitting within a complementary recess in said base portion, said shaft extending through said upstanding projection, and said second spring being a coil spring fitting around said shaft and within the hollow of said spring receiver, said coil spring having one end abutting the lower surface of said top wall of said spring retainer and the other end abutting a bottom wall portion of said case.

8. A switch according to claim 7, said upstanding portion projection fitting within a complementary recess in the bottom wall of said rotor.

9. A switch according to claim 3 or 4, said rotor including an outward projection movable within a fan-shaped recess in said cover member so as to act as a stopper for rotation of said rotor.

10. A switch according to claim 3 or 4, said cover member and said case having aligned recesses in the outer side wall portion thereof, and said switch further including a strap member comprising a generally circular base portion having a hole for receiving said shaft and leg portions extending downwardly, from said base portion, said leg portions each being disposed within respective aligned recesses in the outer side wall portion of said cover member and said case, each said leg portion having a respective fastener portion at its free end inserted through passages provided in the lower ends of the recesses on the outer side wall portion of said case, said fastener potions being bent to secure said switch in assembled condition.

11. A switch according to claim 1, said moving means including means for limiting the rotational movement of said shaft.

* * * * *